US005230512A

United States Patent [19]

Tattershall

[11] Patent Number: 5,230,512

[45] Date of Patent: Jul. 27, 1993

[54] GOLF TRAINING DEVICE

[76] Inventor: H. David Tattershall, 4706 Meyer Way, Carmichael, Calif. 95608

[21] Appl. No.: 880,640

[22] Filed: May 8, 1992

[51] Int. Cl.[5] ..... A63B 69/36

[52] U.S. Cl. ..... 273/186.3; 273/194 A; 273/DIG. 30; 273/187.1

[58] Field of Search ..... 273/194 R, 194 A, 194 B, 273/186.2, 186.3, 186.4, 187 R, 187 A, 187.1, DIG. 30

[56] References Cited

U.S. PATENT DOCUMENTS

| | | | |
|---|---|---|---|
| 2,787,470 | 4/1957 | Barrus et al. | 273/186.3 X |
| 2,992,005 | 7/1961 | Lockhart | 273/187.1 X |
| 3,009,704 | 11/1961 | Heard | 273/179 |
| 3,107,920 | 10/1963 | Strunk | 273/186 R |
| 3,398,961 | 8/1968 | Higdon | 273/194 B |
| 3,649,029 | 3/1972 | Worrell | 273/186 C |
| 3,753,564 | 8/1973 | Brandell | 273/186 A |
| 4,108,441 | 8/1978 | Tredway, Sr. | 273/186 A |
| 4,342,456 | 8/1982 | Miyamae | 273/186.3 X |
| 4,805,913 | 2/1989 | Bott | 273/187 R |
| 4,826,174 | 5/1989 | Hoyt, Jr. | 273/186 R |
| 4,858,934 | 8/1989 | Ladick et al. | 273/186.3 |

FOREIGN PATENT DOCUMENTS

| | | | |
|---|---|---|---|
| 2039749 | 8/1980 | United Kingdom | 273/186.3 |
| 2110095 | 6/1983 | United Kingdom | 273/186.3 |

*Primary Examiner*—George J. Marlo
*Attorney, Agent, or Firm*—Lothrop & West

[57] ABSTRACT

In order to help a golfer to develop "muscle memory" for consistently executing an ideal swing, there is provided a grid plate on which is defined a ball contact zone. Enabling the golfer to see the head of the club as it is swung through the contact zone is a battery-powered L.E.D. mounted on a Velcro-fitted wrap-around jacket. By installing the jacket on the club head and illuminating the L.E.D., instantaneous visual feedback is provided so that aberrations from the ideal path defined by the ball contact zone are detected, interpreted and can immediately be corrected in subsequent swings. Both the jacket and the grid plate possess special features helping to protect against the harmful results of forceful, inadvertent impact between the clubhead and the grid plate.

10 Claims, 5 Drawing Sheets

FIG-6
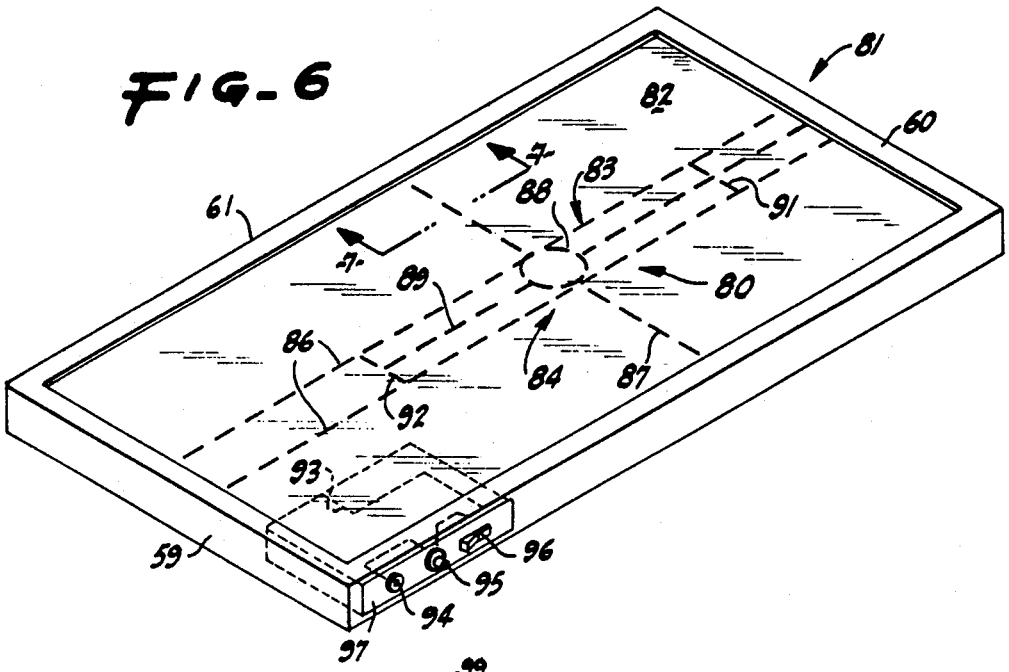
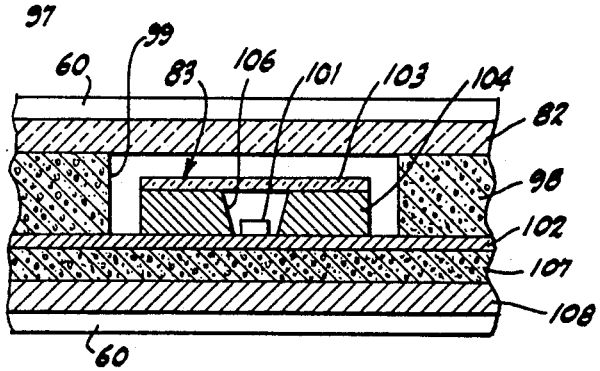
FIG-7
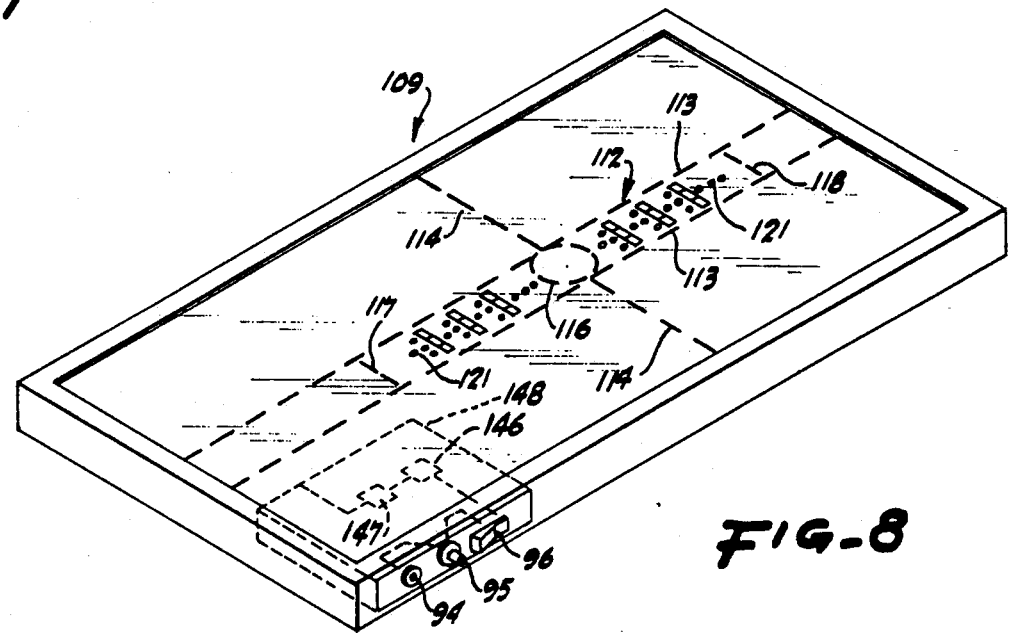
FIG-8

GOLF TRAINING DEVICE

BACKGROUND OF THE INVENTION

1. Field of the Invention.

The present invention relates to a training device to assist golfers in developing a "muscle memory" in order to execute, reliably and consistently, a golf swing in which the face of the club strikes the ball as close to perpendicular to the target line and as near to the center or "sweet spot" of the club face as possible.

2. Description of the Prior Art

For optimum results in terms of accuracy and distance, the manner in which the club head travels through the golf ball contact zone is critical.

In other words, if the club face is maintained at right angles to the target line for a few inches before, at and for a few inches after impact, during the time period that energy is transferred to the ball, a good golf stroke will follow.

It is not sufficient for the club to make tangential contact to "hit" the ball since a golf club when used correctly acts in accordance with the principles of a catapult. A good golf stroke must therefore retain the club on line to allow the storage of energy in both ball and shaft until the point of which the club, in effect, "fires", known as the release.

For most golfers it is not the acquisition or the understanding of this basic knowledge; but, rather, the putting of it into neuro-muscular effect so that good strokes can be made, time after time.

As with all repeatable physical skills, it is necessary to develop a "muscle memory". Such development ordinarily occurs by being able to observe and interpret what needs to be done to correct aberrations from the desired course. Observation poses no problem in learning to pitch a baseball across the plate or tossing a basketball through the hoop. In the case of golf, however, the trainee is told to keep the head still and continue to look down until well after impact has occurred. As a result, there is a relatively considerable time delay between the actual swing and the mental feedback of the results of that swing, obtained by turning the head to follow the flight of the ball.

Even a slight delay impairs the development of "muscle memory" to the fullest extent. Instantaneous feedback is needed. Indeed the player under normal circumstances must complete the stroke and wait, holding the body in a different muscular configuration from that during actual ball contact, until accepting or rejecting visually the result of the stroke. This time delay is considerably greater than for any other physical action at the extreme of average human capability, such as throwing a ball to maximum distance, and is thus a major factor in developing a golf swing.

Once a player can actually see what is happening in the ball contact zone, it is possible to adjust the swing and to reach a repeatable optimum club head path at a much faster rate. In other words, once a golfer is able to see the club head pass through the contact zone, regardless of club head speed, and instantaneously relate the passage through the contact zone to an ideal path, as defined by a zone grid and target line, it follows that repeating the action can more accurately be visualized and the muscle groups necessary for this action can more readily be controlled and trained, consciously or subconsciously.

It is also known that muscle tone varies from day to day and even within any given day. The differences in muscle tone affect the flexibility of the player and thus the ability to repeat accurately the ideal motions required in a good golf swing. It therefore follows that some adjustment may be required to compensate for these changes in muscle tone and that instantaneous visual feedback will reveal the extent of the adjustment required. It also follows that the equipment used to provide the instantaneous feedback must provide the visual stimulus in any lighting condition and in any environment.

In summary, the key to development of "muscle memory" is actual perception of the club head path through the contact zone and instantaneous feedback.

A customary search disclosed the following U.S. patents relating to golf training devices of the instantaneous feedback type:

| | |
|---|---|
| Barrus et al. | 2,787,470 |
| Heard | 3,009,704 |
| Strunk | 3,107,920 |
| Worrell | 3,649,029 |
| Brandell | 3,753,564 |
| Tredway, Sr. | 4,108,441 |
| Bott | 4,805,913 |
| Hoyt, Jr. | 4,826,174 |

Worrell No. 3,649,029 permits visual observation of the club head during the execution of a swing of the golf club by attaching a luminescent decal to the top of the club head; and a desired path of travel of the club head is defined by a grid pattern of luminescent material located on a base mat in front of the golfer. However, in order to be able to utilize the Worrell apparatus, it must be in a light limited environment since an ultra-violet light source must be used. Applicant's device, on the other hand, can conveniently be transported and used at all hours of the day or night and in full sunlight. Further, unlike Worrell's apparatus, applicant's device provides a protective or buffering structure which minimizes damage both to club and to grid in case the club head strikes the grid during the swing.

Lighting attachments for golf clubs are disclosed in Barrus et al. U.S. Pat. No. 2,787,470, in which a normally open weighted switch arm centrifugally actuates light bulbs during the course of a swing; and in Brandell, U.S. Pat. No. 3,753,564 in which an arrangement of lenses and a light bulb provides information relating to the orientation of the club face during practice swings. Neither reference, however, suggests the use of a contact zone delineator nor club buffering against damage from grid impact as in applicant's device.

Heard No. U.S. Pat. No. 3,009,704, uses a combination of lights and photocells, strategically located along an ideal club path for improving the putting stroke. Another putting practice device is disclosed in Hoyt, Jr., U.S. Pat. No. 4,826,174, using parallel rows of posts and parallel guide strips. To similar effect is Strunk, U.S. Pat. No. 3,107,920, in which pivotally actuated bar guides define a club path; but which is not limited to putting practice, as are the Heard and Hoyt, Jr. devices. Applicant's device, however, does not utilize elements which project upwardly above the grid surface and is therefore distinguishable over the references which do define the ideal path of the club head by various types of upwardly protruding elements.

Bott, U.S. Pat. No. 4,805,913, merely illustrates a mat including a stance placement grid and a swing path extension; and Tredway, Sr., U.S. Pat. No. 4,108,441, although providing a light bulb on the club head, utilizes the light to indicate to the golf pupil when the proper position at the top of the backswing is reached.

In summary, the eight references turned up in the search, taken either distributively or in combination, neither anticipate nor make obvious the golf training device of the present invention.

SUMMARY OF THE INVENTION

A specially formed band of elastic material provided with Velcro loop and hook facings is wrapped around and detachably secured to a golf club head to form a protective jacket and a sturdy mounting for a light source.

An L-shaped plate of rigid material mounted on the elastic band and located so as to lie parallel to the club face and club bottom, respectively, affords resistance against fore and aft rotational movement of the jacket in the event the club head inadvertently strikes the grid plate in the course of the swing; and a side retainer on the band includes an opening arranged to receive the base of the hosel, thereby preventing movement in a direction away from the hosel. Abrasion or impact shock resulting from the club head's striking the grid plate is minimized by a relatively thick layer of acrylic, or false, fur on the portion of the jacket underlying the bottom of the club head.

A small but powerful L.E.D., or LED as used herein, protrudes upwardly from a battery housing mounted on the jacket adjacent the face of the club. The axis and position of the LED is inclined from the vertical by an amount that directs the full force of the illumination toward the golfer's eyes.

A second element of the device is a plate positioned below the bottom portion of the arc of a golf swing. The plate has an elongated grid delineated thereon in predetermined patterns, as will subsequently be described in detail.

Preferably, the grid plate is transparent and is constructed of a hard yet smoothly surfaced material so that even if the club head grazes or even severely impacts the plate at the bottom of the arc of the golf swing, the tough acrylic, or false, fur on the bottom of the band minimizes or eliminates damage and allows the smooth finish to be restored by the application of liquid polish to the surface.

In another version, the ball contact zone is delineated by LEDs embedded in the grid plate structure, the LEDs being arranged to light up by turning on a switch.

In still another version, using light-responsive sensors electrically connected to respective colored lights, the lights turn on immediately as a result of the illumination provided to the sensors by a downwardly facing LED on the battery housing mounted on the portion of the jacket adjacent the front face of the club. Thus, when the trainee is practicing with this version of the present invention, only those sensors which "see" the downwardly facing LED will be actuated and cause the associated colored light to light up as the club head sweeps through the contact zone. As the colored lights are turned on, they instantaneously show whether the pupil's golf swing followed or did not follow the ideal path through the contact zone.

SHORT DESCRIPTION OF THE DRAWING FIGURES

Figure 4:
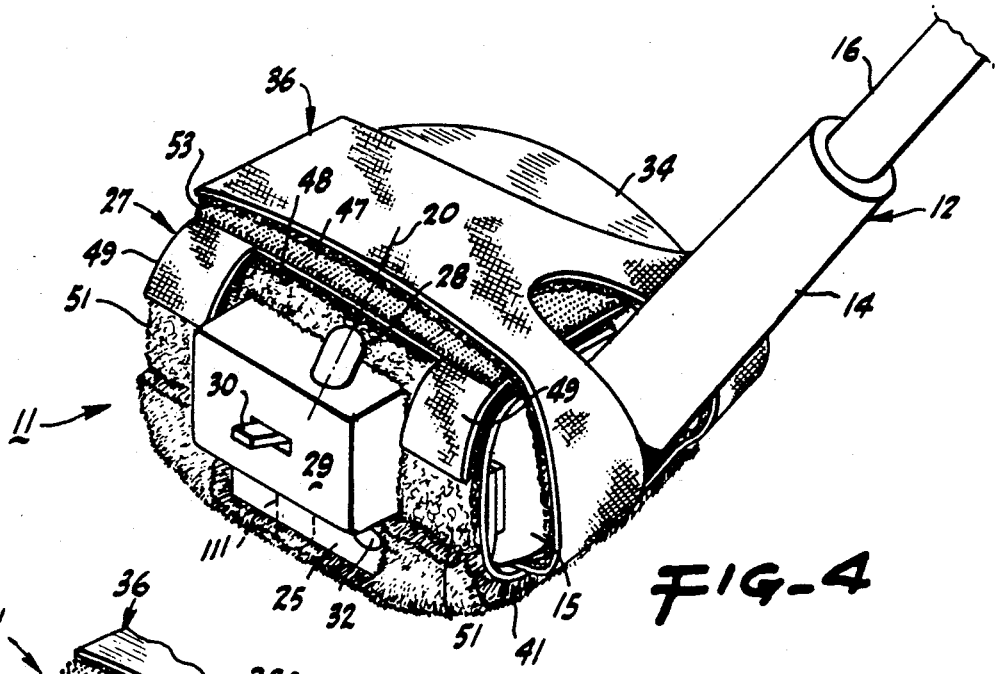
FIG. 4 is a top, front perspective view similar to FIG. 1 but with the club head jacket folded around the club head and secured by the various Velcro hook and loop facings and flaps.
Figure 4A:
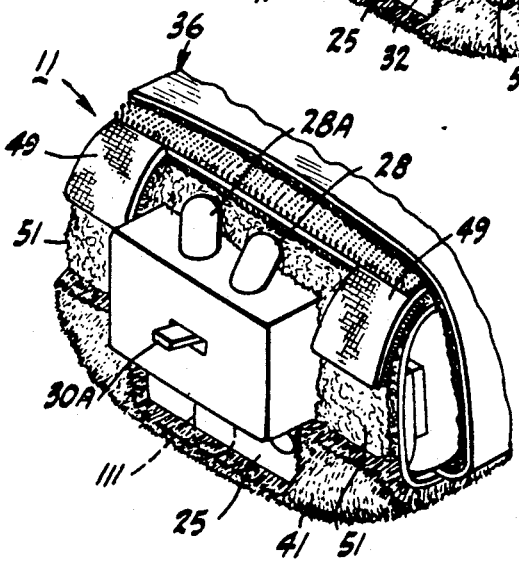
Figure 5:
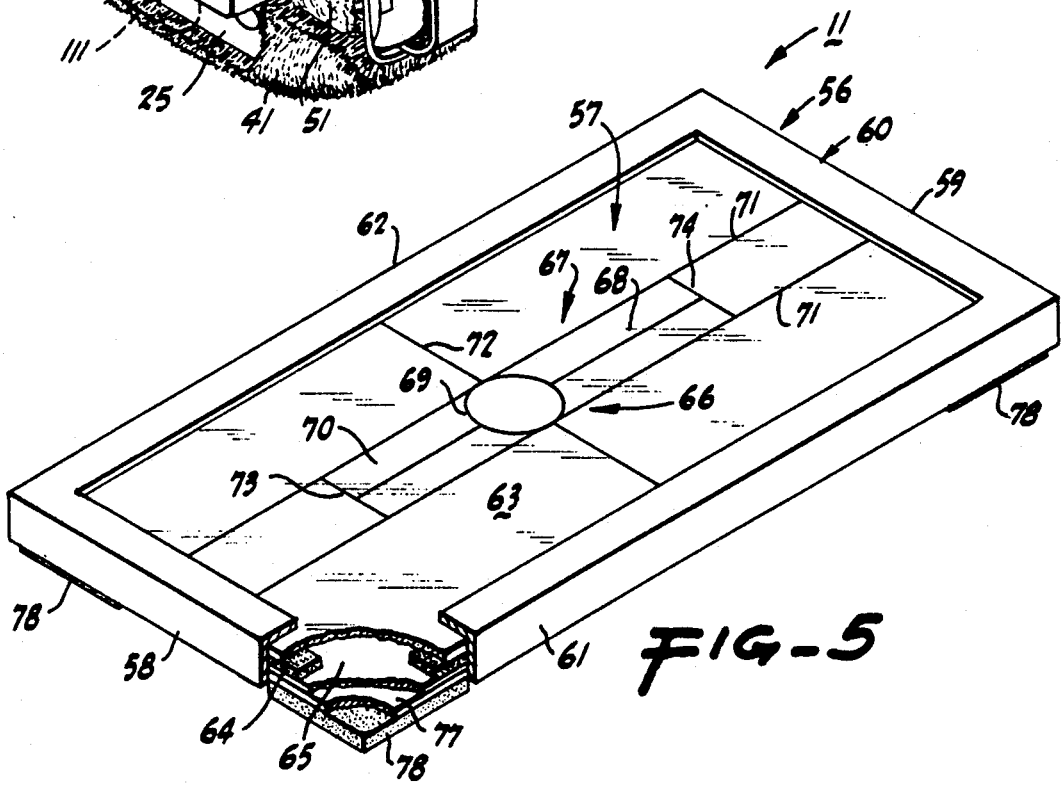
Figure 9:
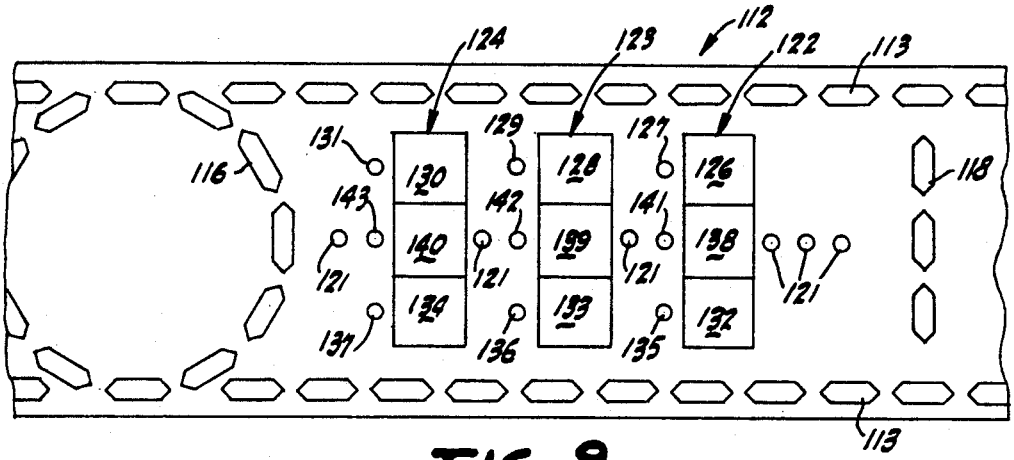
Figure 10:
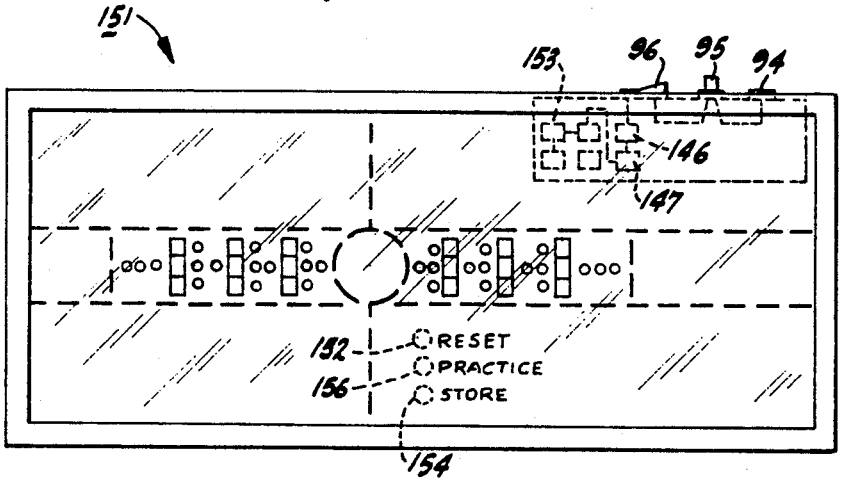
Figure 11:
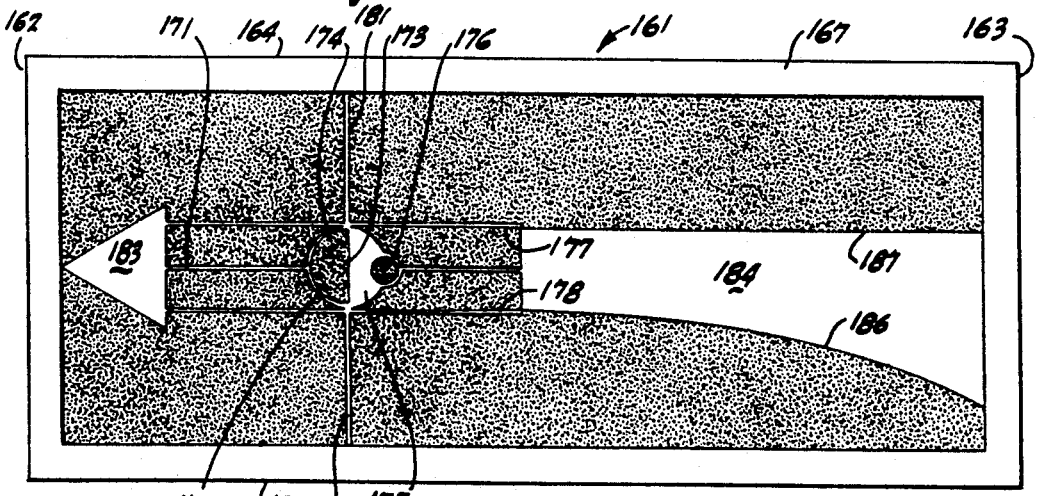

FIG. 4*a* is a perspective view of the battery pack shown in FIG. 4 but with the addition of a second LED;

FIG. 5 is a top front perspective view of a non-illuminated form of grid plate, with portions of the lower left corner broken away to reveal structural details and with the thickness of the parts somewhat exaggerated in the interests of clarity;

FIG. 6 is a top rear perspective view of a grid plate structure in which the grid is delineated by an LED display;

FIG. 7 is a fragmentary sectional view, to an enlarged scale, taken on the line 7—7 in FIG. 6;

FIG. 8 is a top rear perspective view of a modified form of grid plate structure;

FIG. 9 is a fragmentary top plan view, to an enlarged scale, of the right-hand portion of the modified form of grid display shown in FIG. 8;

FIG. 10 is a top plan view of the modified form of grid structure illustrated in FIG. 8, but with the device oriented to the position assumed in use by a trainee, and with additional features; and, FIG. 11 is a top plan view of a preferred form of grid pattern.

DETAILED DESCRIPTION OF PREFERRED FORMS OF THE INVENTION

While the golf training device of the invention can be embodied in numerous different versions, depending upon the environment and requirements of use, it has successfully been embodied and tested in at least some of the forms disclosed herein.

All versions of the device of the invention 11 are utilized in conjunction with a golf club 12, usually one of the standard woods having the usual club head 13, connected by a hosel 14 and enlarged hosel base 15 to a shaft 16 extending upwardly to a handle, not shown. The club head 13, in customary fashion, includes a generally planar front face 18, rear bulge 19, arcuate outer side 21 and inner, or hosel, side 22, as well as a top 23 and bottom 24. The bottom 24 is ordinarily strengthened by the addition of a bottom plate 26 of a tough material, such as steel, enabling the club better to withstand impact and abrasion resulting from golf swings in which, at the lowest point in the arc, the club strikes or impacts the ground, which may comprise turf, hard or soft dirt, gravel, aggregate or other type of surface material.

As previously explained, a main object of the device is to develop in the trainee, or pupil, who may be either a novice or an experienced golfer who has not achieved full potential, a "muscle memory" for an ideal swing in the ball contact zone. Once the golfer can, time after time, strike the ball with the club face coincident with the rear tangential plane of the ball at right angles to the target line, and maintain the club traveling along a straight line parallel to the player's body along an axis through the center of the ball, "muscle memory" has been developed to the stage where variations, such as "fades" and "draws", can be attempted and practiced to achieve similarly skillful results. "Fades" and "draws" are sometimes referred to as "slices" and "hooks", respectively.

Initially, however, a golfer commencing to use the present training device will be more concerned with moving the club head 13 accurately and consistently through an idealized frame of reference, termed a ball contact zone, as heretofore noted.

The phenomenon known as persistence of vision is utilized by installing a very bright source of illumination 28 on the club head 13, with a protective jacket 27 (see FIG. 4) serving as a mounting or base for the light source 28.

Preferably, the light source 28 is an LED and is mounted in a socket in a battery housing 29, or battery pack, with an on-off switch 30 and enclosing a 6-volt battery, not shown. A 5000 M.C.D. red L.E.D. (or LED, as used herein) has been found to provide a very satisfactory light source even in daylight or in at least a partially lighted area, when it is dark.

The LED and battery pack are securely mounted, as by a front mounting strip 25 and a rear backing plate 31 held by blind rivets 32, to a main band 33 of sturdy, knit elastic material, the elastic band 33 forming the core of the jacket 27. A flange 35 integral with the battery pack 29 is interposed between the strip 25 and the plate 31 (see FIG. 3) and includes holes through which the rivets 32 extend.

Various ancillary pieces of fabric and other materials are attached to the main band 33 for a number of different purposes, as will now be described.

In order to help retain the jacket 27 in its installed position on the club head 13, as shown in FIG. 4, and, more particularly, to prevent translation of the jacket in an outward direction, i.e. toward the outer side 21 of the club head, in the event of grid plate impact, for example, there is provided a lateral side retainer 36, or hosel retainer, preferably of a tough vinyl material, secured on the hosel side of the jacket 27, as by stitching 37 or gluing to the adjacent edge portion of the main band 33. An elongated opening 38 in the side retainer 36 allows the jacket 27, in developed condition, as in FIG. 1, to be inserted over the upper end of the club shaft 16 and moved downwardly until stopped by the enlarged hosel base 15.

Upon reaching the club head 13, the main band 33 is urged downwardly and then outwardly so that a pad 41, or glide strip, of thick acrylic false fur, stitched to the main band 33, underlies the bottom 24 of the club head 13. The glide strip 41 not only helps to absorb impact shock in the event the club head is inadvertently struck against the grid plate during a golf practice swing, but it also prevents abrasion. Any scuff marks left by the glide strip 41 can readily be removed by liquid polish.

The dimensions of the glide strip 41 are such that when the jacket 27 is fully installed on the club head I3, the glide strip 41 extends the entire length of the bottom in a fore and aft direction and over at least a major portion of the bottom in a transverse direction, thereby affording protection against abrasion and impact damage even in the case of a poorly executed stroke involving grid plate contact.

On the side of the main band 33 opposite from the side occupied by the glide strip 41 is mounted an L-shaped plate 43 of strong rigid material, such as spring steel.

The short leg 44 of the L-shaped plate 43 extends parallel to the glide strip 41 in developed position of the jacket 27 (see FIG. 3) but is at right angles to the plane of the glide strip 41 in installed position of the jacket 27. In installed position, the short leg 44 is parallel to and adjacent the front face 18 of the club head 13.

The long leg 46 of the L-shaped plate 43, on the other hand, is, in installed position of the jacket 27, parallel to and adjacent the bottom 24 of the club head 13.

The L-shaped plate 43 serves as an anchor which prevents the jacket 27 from rotating in a fore and aft direction, should the club head strike the grid plate in a practice stroke, and the short leg 44 affords an additional sturdy mounting base for the rivets 32 securing the battery pack 29 and light source 28, or LED, by plates 25 and 31 and the interposed battery pack flange 35.

Ready attachability and detachability of the jacket 27 is afforded by Velcro fastenings suitably attached, as by stitching, to various portions of the main band 33.

For example, a Velcro facing 47 of the hook type is mounted on one end of the knit elastic main band 33, with a portion 34 of the main band 33 exposed in the area between the false fur glide strip 41 and the hook facing 47 (as appears most clearly in FIG. 1), to enable the exposed portion 34 of the elastic band 33 to be stretched as it is flexed around the bulge 19 on the after end of the club head and thereby to exert a tensioning, or tightening effect, on the entire jacket 27.

Figures 2, 3:
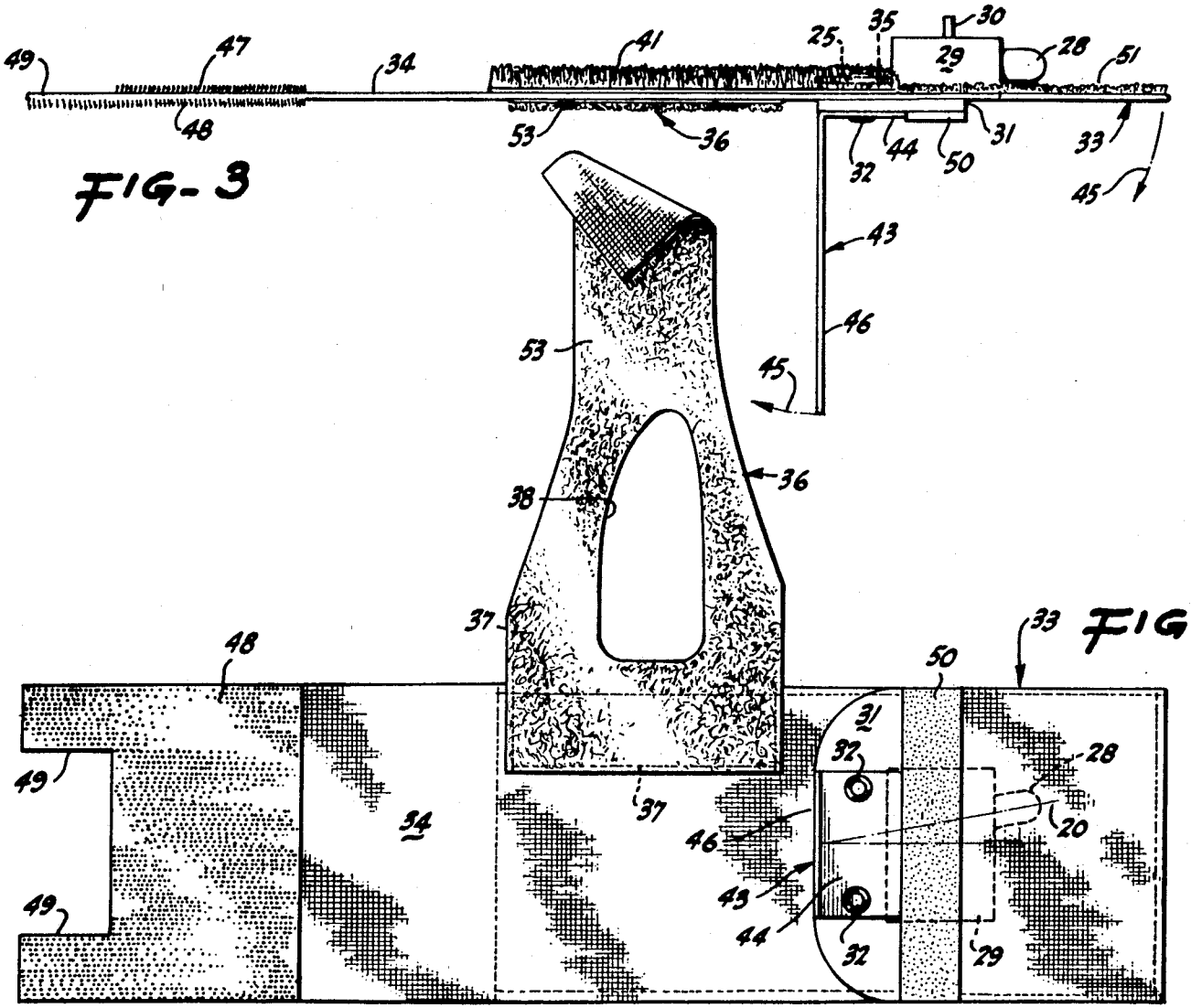
FIG. 2 is a bottom plan view of the developed club head jacket shown in FIG. 1.
FIG. 3 is a side elevational view of the developed club head jacket as viewed from the bottom edge in FIG. 2.

On the same end of the main band 33 and of the same size as the hook Velcro facing 47, but on the opposite surface of the main band 33, is a hook type Velcro facing 48 (see FIGS. 2 and 3). Extending longitudinally beyond the Velcro hook type facing 48 is a pair of flaps 49 also of the Velcro hook type.

On the other end of the main band 33 and on the same side of the band 33 as the hook facing 47 is Velcro facing 51 of the loop type. The loop facing 51 has an opening 52 formed therein to accommodate the battery housing 29.

Figure 1:
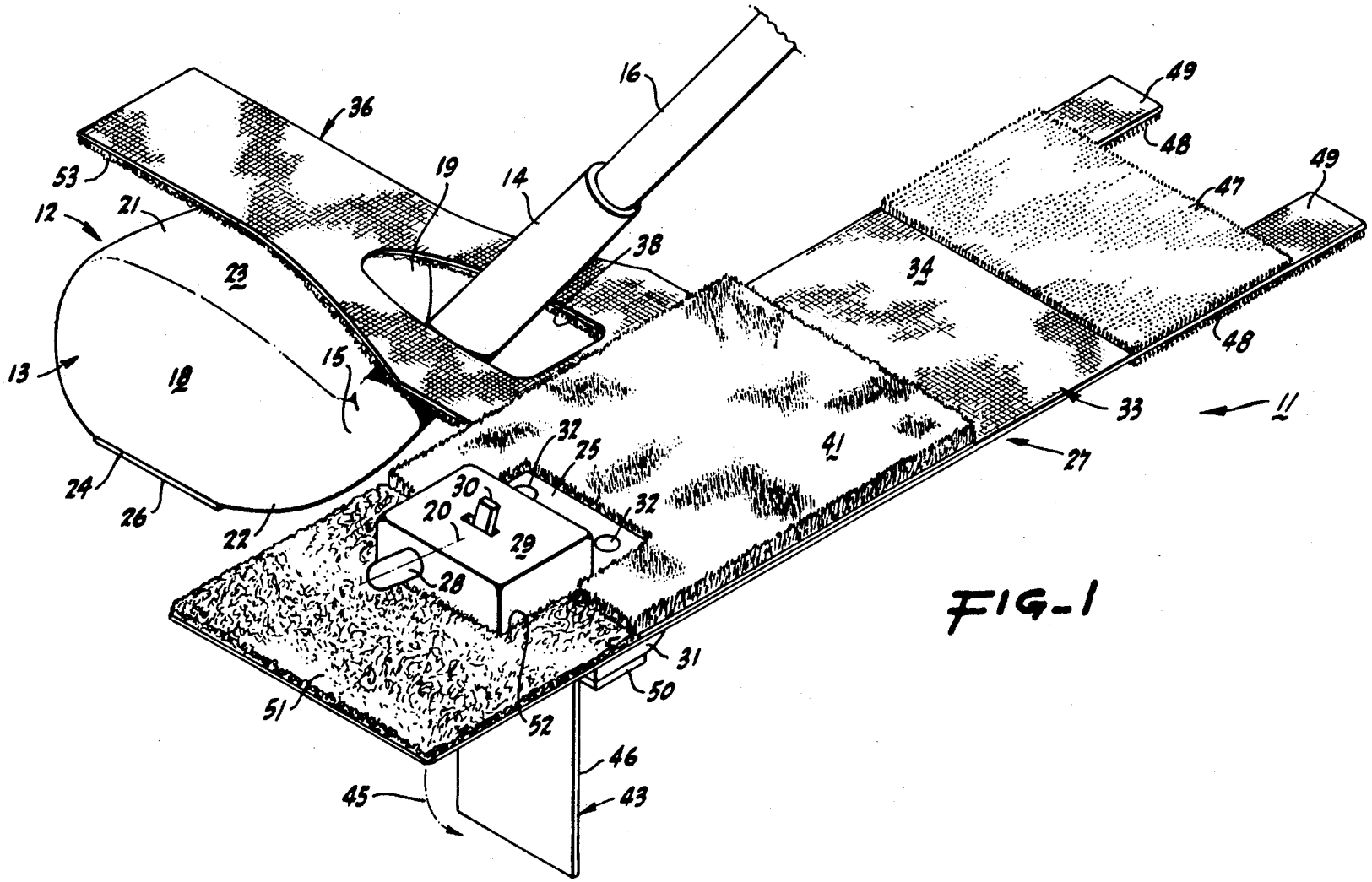
FIG. 1 is a top, front perspective view of the lower portion of a typical golf club with a wooden head being fitted with a club head jacket serving as a mounting for alight source and as a protective cover, the jacket being shown in developed condition.

Conveniently, the side retainer 36, or hosel retainer, is fabricated from a combination of vinyl and Velcro material of the loop type, with the Velcro loop surface 53 (see FIG. 2) facing downwardly toward the top 23 of the club head 13 as the jacket is being installed, as in FIG. 1.

In order to install the jacket 27 on the club head 13 from the position of the parts as shown in FIG. 1, the following sequence is followed:

a. the jacket 27 is lowered until the side retainer 36 is about two inches above the enlarged base 15 of the hosel 14;

b. the loop facing 51 is folded so that the long leg 46 of the L-shaped plate 43 abuts the main band 33 on the surface of the main band opposite to the surface occupied by the false fur glide strip 41 (i.e. in the direction indicated by the arrows 45 in FIG. 3);

c. the jacket 27 is then moved downwardly toward the enlarged base 15 of the hosel 14 while, concurrently, the main band 33 is folded downwardly and outwardly so that the long leg 46 of the plate 43 underlies and abuts the bottom 24 of the club head 13 and the portion of the loop facing 51 carrying the short leg 44 of the L-shaped plate 43, the battery housing 29 and LED 28 are in abutment with the front face 18 of the club head 13, the excess portion of the loop facing 51 being folded over onto the top 23 of the club head 13;

d. holding the glide strip 41 and the loop facing 51 in place against the club bottom 24 and front face 18, respectively, the exposed main band portion 34 aft of the glide strip 41 is stretched and folded, or flexed, around the rear bulge 19;

e. while holding the previously positioned components in place, the hook facing 48 is urged forwardly to overlie and engage the excess portion of the loop facing 51 (the excess portion being located on the top 23 of the club head 13 as stated above);

f. the hook type flaps 49 are thereupon folded down into engagement with the portions of the loop facing 51 on opposite lateral sides of the battery housing 29; and, lastly, g. the loop surface 53 of the side retainer 36 is pressed down into engagement with the underlying hook facing 47.

With the jacket 27 thus firmly installed on the club head, as shown in FIG. 4, the switch 30 can be turned on, lighting the LED 28 and putting the club in condition for use as the first major component of the present training device 11.

By slightly shifting the position of the LED on the battery housing 29 toward the user and inclining the LED 28 away from the vertical by a few degrees, as shown in FIG. 4, the LED axis 20 can be directed to coincide with the line of sight of the user and thereby greatly augment the visual impact of the light source, particularly as it sweeps through the ball contact zone where the golfer's attention is concentrated. An angular inclination of about 10 degrees from the vertical is ordinarily quite suitable; however, in its commercial embodiment, various angular inclinations can be made available to suit the user's preference.

In order to obtain a snug fit between the face 18 of the club head 13 and the short leg 44 of the L-shaped plate 43, and properly align the axis angle of the LED 28, it is sometimes helpful to apply one or more shims 50, or spacers, of an elastomeric material on the adjacent end portion of the rear backing plate (see FIGS. 2 and 3).

A modification of the club head jacket 27 shown in FIG. 4 is illustrated in FIG. 4A, the difference being the addition of a yellow, 5000 M.C.D. LED 28A mounted centrally on top of the battery housing 27 and with its axis vertical. The inclined LED 28 is red in color, as before, but the switch 30A in the modified version is of the four position type affording the user the option of red LED only, yellow LED only, both red and yellow or off.

The addition of the yellow LED enables a golf instructor, located on the target line to the rear of the rid, to determine whether the club head follows the correct path as it swings through the contact zone. At the same time, the pupil can also see the correctness of the path of the club head by observing the red LED with its axis tilted to coincide with the pupil's line of sight to the bottom central portion of the club face.

Having described the construction and operation of various forms of the compact protective club head jacket carrying one or more light sources, details of the companion element of the training device, namely, the grid component 56, or grid structure, will now be disclosed.

As appears most clearly in FIG. 5, the grid structure 56 includes a grid plate 57, preferably somewhat elongated and extending longitudinally from a front end 58 to a rear end 59 and transversely between an inner side edge 61 and an outer side edge 62.

The grid plate 57 is preferably constructed of transparent, tough plastic material, highly resistant to abrasion and impact forces, such as might result from inadvertently misdirected blows of the jacketed club head 13 previously described. The upper surface 63, or impact surface is smooth and scratch resistant. Encompassing the entire outer margin of the grid structure 56 is an edge binding 60.

Supporting and further cushioning the impact plate 63 is a peripheral strip 64 of foam material superimposed on the outer margin of a sheet of paper 65 (see FIG. 5).

Delineated on the upper surface of the sheet of paper 65, as by fluorescent or luminous paint, or ink, or the like, are indicia 66 indicating the ball contact zone 67. Although the grid indicia 66 can assume various different patterns to define the contact zone 67, one very satisfactory arrangement will now be described in which the ball contact zone 67 comprises a center line 68 coincident with the target line, i.e. the imaginary line from the ball to the hole (not shown) or other target. The center line 68 runs in a fore and aft direction through a generally circular marking 69, representing a golf ball, and through the center of an elongated channel 70 about two inches wide, defined by a pair of parallel lines 71 extending the length of the plate 57. A transverse line 72, interrupted by the channel 71, extends through the center of the "ball" 69; and a pair of transverse lines, a forward transverse line 73 and an after transverse line 74, define the forward and after limits of the ball contact zone 67. The length of the center line 68, extending between the transverse lines 73 and 74, is approximately ten inches, equally divided fore and aft from the "ball" 69.

The indicia 66 are readily visible through the superimposed, transparent, impact plate 63 and are protected by the impact plate 63 against abrasion or other damage resulting from club impact.

Preferably, the simulated ball 69 is delineated in yellow color; the center line 68 and transverse lines 73 and 74 are in green color; and the fore and aft parallel lines 71 and the transverse line 72 are in red color.

Providing a sturdy backing for the entire grid structure 56 is a base board 77, of hardboard material, underlying the indicia sheet 65; and supporting the opposite ends of the grid structure 56 is a pair of transverse, anti-skid feet 78, preferably of an elastomeric material.

With the grid 56 in place so that the grid ball 69 is in the location of the customary golf ball when being addressed and with the green center line 68 coinciding with the imaginary target line (not shown), the trainee is ready to begin or resume the practice which will help to develop "muscle memory".

With the LED 28 turned on, the pupil positions the golf club 12 so that the face 18 of the club head 13 addresses the simulated ball 69 on the grid 56. The back swing is begun, in customary fashion, followed by the reversal of club direction at the top of the back swing and then the down swing.

As the club head 13 begins to reach the bottom of the down swing arc, the strong LED 28 on the club head becomes visible to the trainee and remains visible as the club head traverses and then begins to pass beyond the ball contact zone 67. During this arc the path of the club head is visible as a continuous streak of light, owing to the persistence of vision effect.

The pupil is thus able to see, instantaneously, the extent of variation of the actual path of the club head from the ideal path, as delineated on the grid, and store or reject "muscle memory" during the period the club is in the contact zone, thereby eliminating the normal associated time delay discussed earlier.

By repeating this cycle numerous times and by comparing the position of the streak of light with the indicia 66 on the grid plate 57, aberrations from the ideal arc can instantaneously be observed and interpreted so that correction can be made and "muscle memory" can be developed.

Although the indicia 66 delineating the ball contact zone 67 provide a very satisfactory ideal grid background as the light path sweeps forwardly in what appears to be a continuous streak, some trainees prefer that the indicia be in the form of a L.E.D. (or LED as used herein) display 80, as appears in FIG. 6 (which shows the grid structure 81 from the outer, or nether side).

Embedded in the grid structure 81 and protected, again, by a transparent impact grid plate 82 is a plurality of LED units 83, preferably similar in shape to the LED units used for the time indicia customarily used for the numerals on digital clocks, namely, an elongated rectangle with oppositely facing triangles at the ends.

Thus, as appears most clearly in FIG. 6, the individual LED units 83, delineate a ball contact zone 84 substantially identical in size and shape to the zone 67 previously described. The colors of the zone components are also the same, being red for the parallel fore and aft lines 86 and the transverse line 87, being yellow for the simulated ball 88, and being green for the fore and aft center line 89, the forward transverse line 91 and the after transverse line 92.

The LED display 80 is conveniently energized by a 12-volt transformer power supply (not shown) connected to the internal electrical circuitry 93 by a socket 94 located on the side of the grid plate remote from the trainee while practicing. An on-off switch 96 connected in the circuitry 93 controls the LED display 80; and a fuse 95 protects against overloads.

Preferably, the socket 94, fuse 95, switch 96 and attendant circuitry are installed on a mounting board 97 removably disposed in a recess in the grid structure 81, as shown in FIG. 6; and the circuitry 93 includes connections to a printed circuit board of conventional construction serving to actuate the individual LED display units 83, also disposed in recesses in the grid structure 81.

FIG. 7 is a cross-section, taken on the line 7—7 in FIG. 6, and illustrates schematically, and to an enlarged scale, the construction of the illuminated form of grid structure 81.

As before, the margin of the grid structure 81 is covered by an edge binding 60; and, facing upwardly to receive the inevitable impacts of a club head, is a tough, transparent plastic impact plate 82 supported on a cushion 98 of upholstery grade foam to absorb the energy of impact transferred by the club head to the impact plate when impact occurs. Instead of luminous indicia on a sheet of paper, however, the foam cushion 98 has recesses 99 formed therein to receive the various LED display units 83, previously noted.

As schematically shown in FIG. 7, each of the LED units 83 includes a light source 101 in electrical connection with a printed circuit board 102; and the color of the unit 83, as seen by the trainee, is determined by the tint of a plastic sheet 103 (red in the section shown, of transverse line 87). The colored sheet 103 is supported on a rigid foamed plastic block 104 having a plurality of compartments 106 formed therein to receive the LED light source 101. The compartments 106 are preferably shaped, or configured, to resemble the LED units as they appear in a digital clock, as previously explained. The tips of the end triangles of adjacent units 83 substantially touch so that the appearance from even a close distance is virtually that of a continuous line.

Supporting the printed circuit board 102 is a base cushion 107 of resilient foam and a sturdy base board 108 of hardboard. The lowermost portion of the edge binding 60 underlies the outer margin of a sturdy base board 108.

The LED display grid structure just described is used in much the same fashion as the luminous paint grid structure previously disclosed. Both utilize the streak of light effect resulting from the upwardly directed light source 28 mounted on the club head 13. The main difference is that an external source of considerable illumination is required to observe the luminous paint grid background previously described whereas the grid delineated by the LED display can be utilized with only a minimum of external illumination.

A somewhat more sophisticated grid structure 109 is illustrated in FIGS. 8 and 9. In this version, the upwardly facing LED 28 on the club head 13 can continue to be used, if desired.

However, in the case of the grid 109, a downwardly facing LED 111, illuminated by connection to a socket in the bottom of the battery pack 29 is used (see FIG. 4). The downwardly facing LED 111 serves to actuate one or more of a plurality of conventional light-responsive sensors, generally designated by the reference numeral 112.

As in the version shown in FIG. 6, the grid pattern includes a pair of parallel lines of red LED units 113 extending in a fore and aft direction for the full length of the grid structure and a pair of co-linear red transverse lines of LED units 114 perpendicular to the parallel lines, as well as a "circle" of yellow LED units 116 representing a golf ball.

There are also transverse terminal lines of green LED units 117 and 118. However, in the present form of grid device, the center line, although still delineated by a row of green lights, is generally designated by the reference numeral 121.

In the embodiment illustrated in FIGS. 8 and 9, there are, in fact six green lights 121 defining a center line and nine light-responsive sensors 112 upstream from the yellow ball units 116 and nine sensors 112 downstream therefrom, as shown in FIG. 8.

The light responsive sensors 112 are arranged in three transverse, successive rows 122, 123 and 124 (see FIG. 9) with three sensors in each row.

Each of the sensors 112 is linked, electrically, to a respective light of the same type as the green center line lights 121, for example, 75 M.C.D. L.E.D. (LED herein) type of lights. Thus, in the outer, or nether, fore and aft line, as appears most clearly in FIG. 9, the first sensor 126 controls a LED 127; the second sensor 128 controls the LED 129; and the third sensor 130 controls the LED 131. All of the three LEDs 127, 129 and 131 are RED in color. Thus, if, during the descending arc of the trainee's swing the downwardly facing LED 111 carried on the club head 13 sweeps over the sensors 126, 128 and 130, all three of the RED LEDs 127, 129 and 131 will glow and the trainee will instantly know that the club head was too far "out" in passing through the ball contact zone.

If, on the other hand, the swing was executed with the club head too far "in", or toward the trainee's feet, the LED 111 on the club head will have actuated, in sequence, the sensors 132, 133 and 134 and the respective LEDs 135, 136 and 137. These three LEDs are BLUE. Thus, a line of BLUE LEDs will instantly tell the trainee that the club head should be swung slightly farther out on subsequent practice swings.

Acting on this knowledge and serving to develop "muscle memory", the ideal swing will cause the downwardly facing LED 111 on the club head to sweep across the centrally located, successive light-responsive sensors 138, 139 and 140 and the respective GREEN LEDs 141, 142 and 143, will be turned on, with all three GREEN LEDs in alignment with the previously lighted GREEN LEDs 121 in the center line.

This linear array of nine green LEDs instantaneously informs the trainee that an ideal swing has just been executed; and that by subsequently using the same muscle groups in the same way, a similar result will follow. Thus is "muscle memory" developed.

Where the arc is diagonal through the ball contact zone, there may be RED, GREEN and BLUE LEDs turned on. This type of display indicates to the novice that improvement is needed.

Although the circuitry connecting the power source, the light-responsive sensors 112 and the respective lines of colored lights is susceptible of numerous different embodiments, one satisfactory way is to utilize, in the circuit, an R.0.M. chip 146 to control the lighting relative to the sensors 112 and an R.A.M. chip 147 which initiates the necessary switching to the circuitry from instructions of the previously programmed R.0.M. chip 146. These chips are shown schematically in broken line in FIG. 8 as being part of a removable mounting board 148, as before.

A still further embodiment is illustrated in FIG. 10 in which additional electronic components are installed in a grid structure 151 and connected so as to enhance the utility and convenience of the device. In FIG. 10, the grid 151 is shown in its normal orientation during use.

Additional components could include a light-responsive RESET sensor 152, enabling the trainee to turn off all of the temporary RED, BLUE or GREEN LEDs actuated by the light-responsive sensors 112 merely by passing the downwardly facing LED 111 over the reset sensor 152. This feature may, of course, also be incorporated in the grid structure 109 shown in FIGS. 8 and 9.

Another helpful addition, especially for particularly studious and serious trainees, is a memory unit 153 which selectively stores information received from the light-responsive sensors 112 in a memory circuit. By using still other conventional electronic components, in well known manner, the stored results can be tallied and downloaded as a graphic display on the trainee's PC or as hard copy for study and comparison, to illustrate progressive improvement in "muscle memory." A convenient light-responsive STORE sensor 154 connected to the memory bank 153 can be actuated by moving the club head so that the downwardly directed LED 111 on the club head can be "seen" by the store sensor 154.

Should the trainee wish to return to the basic LED display delineating the ball contact zone (as shown in FIG. 6) a light-responsive PRACTICE sensor 156, suitably connected to the circuitry heretofore described, can be actuated, as described above, by moving the club head so that the downwardly facing LED 111 is superimposed over the PRACTICE sensor 156.

Although the rectangular-shaped grids heretofore described and illustrated in FIGS. 6–10 disclose various modifications in the way the basic grid of FIG. 5 can be illuminated, it is also considered important that the grid pattern provide indicia which coincide substantially with the arcuate path of a golfer's swing.

In other words, just prior to entering the ball contact zone 67, which is linear and fore and aft in orientation, the head of the golf club moves in a curvilinear, or arcuate, path to which the fore and aft linear path through the ball contact zone is tangent.

So that the overall grid pattern will conform to the combination of the arcuate and linear paths just described, and thereby enhance the pupil's "muscle memory" the pattern shown in FIG. 11 was developed.

As before, the grid plate 161 is preferably rectangular in shape, with a forward end 162, after end 163, far side 164 and near side 166, with a margin 167, or border, around the periphery.

The left-hand portion of the grid pattern (when viewed by a right-handed golfer) is not unlike the grid pattern heretofore described in that it includes a white center line 171, or target line, on which a simulated golf "ball" 172 is centered. Bisecting the ball 172 is a transverse line 173 defining the after end of a black semicircle 174. The right half 175 of the ball is white but is distinguished by a small red circle 176 centered on the center line 171 and covering the right-hand "end" portion of white half, as shown in FIG. 11.

Parallel to the center line 171 and spaced apart by the diameter of the ball 172 is a pair of fore and aft lines 177 and 178; and co-linear with the transverse line 173 of the ball 172 is a pair of spaced transverse lines 181 and 182.

At the forward end of the lines 177 and 178 there is an isosceles triangle, 183 in white representing an arrow head and calculated to convey a strong sense of power in a forward direction, toward the target and centered on the target line.

At the after end of the parallel, fore and aft lines 177 and 178, is an elongated area 184, in white, extending to the margin on the after end 163 of the grid plate. The unique aspect of the area 184 is the arcuate boundary 186 of the area adjacent the user. The arcuate boundary 186 generally traces the curvilinear path of the descending club head as it approaches the grid plate, the arcuate path merging tangentially into the fore and aft line 178 as the club head enters the ball contact zone.

The nether boundary 187 of the white area 184 is fore and aft in orientation and co-linear with the line 177.

Preferably, the parallel fore and aft lines 177 and 178 are red in color, as are the co-linear transverse lines 181 and 182, along with the small red ball located at the after "end" of the white semicircle 175.

It is to be noted that while, in its simplest embodiment, the grid pattern (comprising the white center line 171 and the white areas, as well as the red lines and red circle, all superimposed upon a black background) can be delineated in the manner shown, as by paint or ink, it is also possible to form the various indicia by means of the grid-illuminating techniques disclosed in connection with the rectangular grid plates previously described and illustrated in FIGS. 6–10.

The black, white and red lines and areas in FIG. 11 have been selected to allow for color blind players and to intensify visual stimulus.

The "takeaway" (backswing) and "downswing" area 184, is linear shaped in part to stimulate a straight line "takeaway" and is curved in part to allow a variety of swing paths on the downswing. The area provides as well, a transition from an arc to a linear path through the critical contact zones.

The forward end of the contact zone terminates in an arrowhead visually to help stimulate the player to keep the club head on line toward the target. The rear one half of the simulated ball is white and is thus emphasized to encourage the player to concentrate on the after portion of the ball. This is reinforced by placing a small red circle on the ideal point of contact between club head and ball.

The parallel lines 177 and 178 are red, as are the co-linear transverse lines 181 and 182, the former defining the limits of the contact zone and the latter providing a reference for positioning the feet when addressing the ball.

Golfers who have become indoctrinated in the techniques associated with the present device in its various embodiments and who wish to extend the opportunity to develop "muscle memory" can do so by utilizing simplified expedients as they play a round of golf on the course, or, for that matter, at any time. In other words, the golfer can use a protective jacket 27 comparable to that previously disclosed, but one in which the glide strip 41, of acrylic, false fur material is, instead, constructed of a thin strip of leather, or the like.

This modified jacket can be fitted to the club head, as before, and used during an actual round since the leather provides protection from contact with the ground. The player need merely draw a line on the ground, or use any type of straight line on the ground, to provide a reference enabling the player to observe the nature of the swing and to correct it with the view of improving "muscle memory".

What is claimed is:

1. In combination with a golf club including a handle, a shaft, a hosel and a head, the head having a front face, a rear bulge, a top and a bottom, a golf training device comprising:

a. an elongated band having a width sufficient to cover at least a portion of the width of the golf club head and a length sufficient to cover at leat a portion of the perimeter of the golf club head in a fore and aft plane perpendicular to the top and bottom;

b. means for securing said band in wrapped position around the club head in a fore and aft direction;

c. a light source;

d. means for mounting said light source on said band;

e. a battery connected to said light source; and, f. a compressible impact absorbing glide strip mounted to said band so that when said band is in said wrapped position, said glide strip extends the full length of the bottom in a fore and aft direction and over at least a major portion of the bottom in a transverse direction, said glide strip thereby affording protection against abrasion and impact damage in the event of contact between the bottom of the club head and an underlying surface during the course of a swing with the golf club.

2. A golf training device as in claim 1 in which said band is of elastic material, said band securing means includes loop and hook facings on said band and said compressible impact absorbing glide strip is of acrylic false fur material.

3. A golf training device as in claim 1, including means for preventing rotational movement of said band in a fore and aft plane as the bottom of said club head encounters a glancing blow with a stationary object in the course of a golf swing.

4. A golf training device as in claim 3 in which said rotational movement preventing means is an L-shaped strip of rigid material mounted on said band and having a short leg overlying the face of the club and a long leg engaging the bottom of the club.

5. A golf training device as in claim 1 including means for preventing lateral movement of said band in a direction away from the hosel.

6. A golf training device as in claim 5 in which said lateral movement preventing means is a side retainer mounted on one edge of said band, said side retainer including an opening large enough to accommodate the diameters of the club handle shaft and hosel as said opening in said band is inserted over the upper end of the club handle and said band is moved down to abut the junction of the hosel and the club head; and means for securing said side retainer to said band.

7. A golf training device comprising:

a. a light source;

b. means for detachably mounting said light source on the head of a golf club with said light source oriented upwardly toward the eyes of the trainee when said club head is located in the bottom portion of the arc of the golf swing;

c. a transprent, resilient, ground-supported plate positioned horizontally on a surface located below said bottom portion of the arc of the golf swing, said plate being of smooth, scratch-resistant and impact-resistant material;

d. a sheet having delineated thereon an elongated grid pattern visible through said plate with the longitudinal axis of said pattern oriented in a fore and aft direction and with the transverse axis located approximately at said bottom portion of the arc of the golf swing so that the trainee simultaneously views said grid pattern and the path of the light source at said bottom portion of the arc of the golf swing;

e. a battery detachably mounted on said club head and connected to said light source for illuminating said light source during the golf swing; and, f. a compressible impact absorbing glide strip detachably mounted on the bottom of said club head, said glide strip being constructed of soft, fur-like material to mitigate the effect of impact between said club head and said plate in the event of contact during the golf swing.

8. A golf training device as in claim 7 including a band of elastic material stretched over and detachably secured to said club head to cover portions of said club head; said light source, said battery and said gluide strip being mounted on said band for installation on and removal from said club head together with said band.

9. A golf training device as in claim 8 including means for preventing rotational movement of said band in a fore and aft direction as the bottom of said club head strikes said plate in the event of contact during the golf swing.

10. A golf training device as in claim 9 in which said fore and aft movement preventing means is an L-shaped strip of rigid matrial mounted on said band and having a first leg overlying the face of said club head and a second leg engaging the bottom of said club head.

* * * * *